United States Patent [19]

Couper

[11] Patent Number: 4,737,339

[45] Date of Patent: Apr. 12, 1988

[54] POWDER-METALLURGICAL PRODUCTION OF A WORKPIECE FROM A HEAT-RESISTANT ALUMINUM ALLOY

[75] Inventor: Malcolm J. Couper, Siggenthal, Switzerland

[73] Assignee: BBC Brown Boveri AG, Baden, Switzerland

[21] Appl. No.: 84,017

[22] Filed: Aug. 11, 1987

[30] Foreign Application Priority Data

Aug. 12, 1986 [CH] Switzerland ..... 3232/86

[51] Int. Cl.[4] ..... B22F 1/00

[52] U.S. Cl. ..... 419/23; 419/33; 419/39; 419/48; 419/67; 75/0.5 BA; 75/249

[58] Field of Search ..... 419/23, 33, 39, 48, 419/67; 75/249, 0.5 BA

[56] References Cited

U.S. PATENT DOCUMENTS

| | | | |
|---|---|---|---|
| 4,127,426 | 11/1978 | Nicoud | 419/23 |
| 4,347,076 | 8/1982 | Ray et al. | 419/23 |
| 4,435,213 | 3/1984 | Hildeman et al. | 75/249 |
| 4,647,321 | 3/1987 | Adam | 75/249 |

*Primary Examiner*—Stephen J. Lechert, Jr.

*Attorney, Agent, or Firm*—Oblon, Fisher, Spivak, McClelland & Maier

[57] ABSTRACT

A workpiece consisting of a heat-resistant aluminum alloy is produced by a powder-metallurgical process wherein an alloy containing 8 to 14% by weight Fe, 0.5 to 2% by weight V and 0.2 to 1% by weight Mn is melted, the melt is cooled in a gas stream at a rate of at least $10^5$ °C/s and is atomized to form particles having a diameter of 1 to 40 μm, whereupon the powder is consolidated a temperature of 350° to 450° C. at a pressure of 2000 to 6000 bar, to form a pressed article. In this process, the intermetallic compound $Al_6Fe$ stabilized by Mn occurs in fine distribution. This dispersoid imparts high ductility and toughness to the grain.

6 Claims, No Drawings

POWDER-METALLURGICAL PRODUCTION OF A WORKPIECE FROM A HEAT-RESISTANT ALUMINUM ALLOY

TECHNICAL FIELD

Heat-resistant aluminum alloys, which are produced from powders obtained with a high rate of cooling by atomization of a melt. A high content of alloy components, e.g. Fe and Cr, which are not acceptable under otherwise conventional solidification conditions.

The invention relates to the production of aluminum alloy powders and the production of pressed articles from these powders.

In particular, it relates to the powder-metal-lurgical production of a workpiece from a heat-resistant aluminum alloy of the Al/Fe/X type with 5 to 15% by weight Fe, where X represents the element V and/or Mn. (cf. GB-PS No. 2,088,409 A).

PRIOR ART

Aluminum alloys which are suitable for the production of powders from melts by means of gas-jet atomization with the application of very high rates of cooling ($10^{5°}$ C./s and above) and may be employed for the production of heat-resistant workpieces, have become known in numerous variations. A significant group is represented by the polynary alloys, in most cases exhibiting relatively high iron contents, of the Al/Fe/X type, where X represents at least one of the elements Ti, Zr, Hf, V, Nb, Cr, Mo and W. In this connection, an alloy containing 8% by weight Fe and 2% by weight Mo clearly adopts a special position (cf. GB-PS No. 2,088,409 A).

With these aluminum alloys, it is quite generally attempted to take into account and to optmize precipitation hardening and/or dispersion hardening. Binary and ternary intermetallic compounds play an essential part. In this connection, reference is frequently made to the intermetallic compound $AL_3Fe$ as an important constitutive phase and to a micro-eutectic structure formed in the powder grain at a high rate of cooling (cf. C. M. Adam and R. G. Bourdeau in: R. Mehrabian et al, eds., Rapid Solidification Processing, Batou Rouge, 1980, p. 246; C. M. Adam in: 8.H Kear et al, eds., "Rapidly Solidified Amorphous and Crystalline Alloys", 1982; W. J. Boettinger, L. Bendersky, J. G. Early, submitted to Met. Trans A (1985) and M. J. Couper and R. F. Singer in: M. Koczak and G. Hildeman (eds.), Conference proceedings, High Strength PM Aluminium Alloys, 1985, in Press.).

The properties of the known alloys and of the pressed and formed articles produced therefrom in accordance with powder-metallurgical methods still leave something to be desired. In particular, the toughness and the ductility of such workpieces are inadequate for many applications.

Accordingly, there is a great need for a further improvement in known alloys and for a refinement of the production methods for finished products.

DESCRIPTION OF THE INVENTION

The object of the invention is to provide a process for the powder-metallurgical production of a workpiece from a heat-resistant aluminum alloy with due consideration of optimal alloy composition and adaptation of the process steps, which process leads to tougher and more ductile finished products without loss of strength. In this connection, it is intended that, in the powder production, phases, stable even at higher temperatures, should be achieved, which—irrespective of the particle size—are homogeneously distributed over the entire powder grain and impart to it a high degree of deformability.

This object is fulfilled in that, in the process initially mentioned, an alloy is selected, which contains 8 to 14% by weight Fe, 0.5 to 2% by weight V and 0.2 to 1% by weight Mn, the alloy being melted, the melt being atomized in a gas stream to form particles having a diameter from 1 to 40 μm at a rate of cooling of at least $10^{5°}$ C./s, the dispersoids formed in this manner being homogeneously distributed and no micro-eutectic zone being present within a powder particle, and in that the powder is compacted at a temperature of 350° to 450° C. at a pressure of 2000 to 6000 bar, in such a manner that the intermetallic $Al_6Fe$ phase stabilized by Mn is formed in fine distribution and the $Al_3Fe$ phase is to a large extent suppressed.

MODE OF IMPLEMENTING THE INVENTION

The invention is explained with reference to the example which follows.

EXAMPLE

An alloy of the following composition was melted:

Fe=10% by weight
V=1% by weight
Mn=0.5% by weight
Al=remainder.

The melt was atomized in a device by means of a gas stream (nitrogen) while maintainng a rate of cooling of at least $10^{5°}$ C./s, to form a powder. The average particle diameter was approximately 20 μm, and the maximum approximately 40 μm. The structure of the particles was defined by a uniform distribution of the dispersoids, while the interfering micro-eutectic structure occurring otherwise in conventional alloys was absent.

Approximately 160 g of the powder was compressed by hot pressing in a mold at a pressure of 3000 bar at a temperature of 400° C., to form a slug of approximately 99% of theoretical density. In this procedure, the heating-up time in the mold was approximately 45 min. The slug had a diameter of 40 mm and a height of 60 mm. This slug was inserted into the cylinder of an extrusion press and compressed, at a pressure of 5000 bar at a temperature of 400° C., to form a rod having a diameter of 13 mm. The reduction ration was approximately 9:1.

Sample pieces were cut out from the rod, and the mechanical properties were measured at room temperature and at 300° C. The yield strength at room temperature was 450 MPa. A metallographic examination revealed the presence of considerable proportions by volume of the $Al_6Fe$ phase, while practically no $Al_3Fe$ could be detected. Furthermore, no non-deformed powder particles containing $Al_3Fe$ were present in the consolidated material.

The invention is not restricted to the exemplary embodiment. The aluminum alloy may, in principle, have the following composition:

Fe=8 to 14% by weight (preferably 10 to 14% by weight)
V=0.5 to 2% by weight
Mn=0.2 to 1% by weight
Al=remainder.

The rate of cooling in the powder production should be at least $10^{5}$° C./s. The particle diameter of the powder produced by gas-jet atomization should be within the limits of 1 to 40 μm. The consolidation of the powder can take place at temperatures between 350° and 450° C. at pressures of 2000 to 6000 bar. Preferred values are 400° C. for the powder compression.

Further advantageous alloy compositions are:

Fe=10 to 12% by weight
V=1% by weight
Mn=0.4 to 1.0% by weight
Al=remainder, or:

Fe=12% by weight
V=1.5% by weight
Mn=1.0% by weight
Al=remainder.

I claim:

1. The powder-metallurgical production of a work piece from a heat-resistant aluminum alloy of the Al/Fe/X type with 5 to 15% by weight Fe, where X represents the element V and/or Mn, wherein the alloy contains 8 to 14% be weight Fe, 0.5 to 2% by weight V and 0.2 to 1% by weight Mn, the alloy being melted, the melt being atomized is a gas stream to form particles having a diameter from 1 to 40 μm at a rate of cooling of at least $10^{5}$° C./s, the dispersoids formed in this manner being homogeneously distributed and no microeutectic zone being present within a powder particle, and wherein the powder is consolidated at a temperature of 350° to 450° C. at a pressure of 1000 to 5000 bar, in such a manner that the intermetallic $Al_6Fe$ phase stabilized by Mn is formed in fine distribution and the $Al_3Fe$ phase is to a large extent suppressed.

2. The production of a workpiece as claimed in claim 1, wherein the alloy exhibits an Fe content of 10 to 14% by weight.

3. The production of a workpiece as claimed in claim 2, wherein the temperature during the powder consolidated is 400° C.

4. The production of a workpiece as claimed in claim 1, wherein the alloy exhibits the following composition:

Fe=10 to 12% by weight
V=1% by weight
Mn=0.4 to 1.0% by weight
Al=remainder.

5. The production of a workpiece as claimed in claim 4, wherein the alloy exhibits the following composition:

Fe=10% by weight
V=1% by weight
Mn=0.5% by weight
Al=remainder.

6. The production of a workpiece as claimed in claim 1, wherein the alloy exhibits the following composition:

Fe=12% by weight
V=1.5% by weight
Mn=1.0% by weight
Al=remainder.

* * * * *